United States Patent [19]

Martin

[11] 4,069,534

[45] Jan. 24, 1978

[54] DRAIN OPENER

[76] Inventor: Arthur Seymon Martin, 2316 French St., Santa Ana, Calif. 92706

[21] Appl. No.: 705,141

[22] Filed: July 14, 1976

[51] Int. Cl.[2] ..... B08B 9/02

[52] U.S. Cl. ..... 15/104.3 SN

[58] Field of Search ..... 15/104.05, 104.09, 104.16, 15/104.3 SN, 104.3 R

[56] References Cited

U.S. PATENT DOCUMENTS

| | | | |
|---|---|---|---|
| 1,151,357 | 8/1915 | Grosvold | 15/104.3 SN |
| 1,888,269 | 11/1932 | Herst | 15/104.3 SN X |
| 2,589,556 | 3/1952 | Kjerulff | 15/104.3 R |
| 3,588,938 | 6/1971 | Guerrini | 15/104.3 SN |

FOREIGN PATENT DOCUMENTS

| | | | |
|---|---|---|---|
| 676,492 | 12/1963 | Canada | 15/104.3 SN |
| 1,277,675 | 6/1972 | United Kingdom | 15/104.3 SN |

*Primary Examiner*—Edward L. Roberts
*Attorney, Agent, or Firm*—Allen A. Dicke, Jr.

[57] ABSTRACT

An improved drain "snake" head having rotating bearings. Bearings operating upon a transverse axis. A flexible, but stiff, wire line with the described head at the forward terminus for projecting through the pipe trap or gooseneck underneath a sink, lavatory, or similar structure.

3 Claims, 3 Drawing Figures

DRAIN OPENER

BACKGROUND

This invention is directed to a drain opener, and particularly a flexible drain opener structure suited for traversing tight undersink bends for the opening thereof.

Pipe and tube cleaning implements of various types and sizes have been developed. The common equipment is divided into two types. One is a flat, metallic tape of sufficient thickness to be stiff enough to thrust endwise through a pipe. To prevent the normally sharp, flat forward end of it from hanging up in a pipe at the joints or bends thereof, a head is secured thereon. Heads of various styles and shapes have been produced. These steel, tapelike sewer rods have been unable to successfully negotiate turns and bends in smaller plumbing parts.

The more common type of sewer cleaning implement comprises a metallic wound wire springlike structure which is more flexible than the steel tape, is able to bend in any plane, and is able to rotate while bent. Therefore, the coiled wire type of pipe cleaning implement is more widely used, both in large sized equipment and in smaller size. Various types of heads have been provided for such pipe cleaning implements from an inexpensive structure which merely comprises an enlarged forward coil of the main spring wire body to more complex structures which are secured on the forward end. These more complex structures include partially spherical guides and other types of heads which act either as a guide or as a cleaning device. None of the guides is particularly designed for negotiating the sharp turns in undersink plumbing and thus have not been suitable for such use. The prior art guides jam in the pipe when a turn is to be negotiated in the pipe or jam on a corner at a pipe joint. The prior art structures have not been designed to be capable of passing through and cleaning the common undersink traps.

SUMMARY

In order to aid in the understanding of this invention, it can be stated in essentially summary form that it is directed to a drain opener wherein at least one guide roller is particularly shaped and sized to guide a flexible wire line through the gooseneck trap in a sink drain.

It is thus an object of this invention to provide a wire line drain opener which is capable of passing into and through sink drains for the cleaning of the gooseneck traps beneath a sink, lavatory, or similar plumbing structure. It is another object to provide a wire line drain opener which has at least one guide roller capable of opening undersink drains without necessitating disassembly thereof to more quickly accomplish undersink drain opening with lesser skill required and without appreciable mess, which often occurs when the undersink trap needs disassembly. It is another object to provide a wire line drain opener having one or more shaped guide rollers for passing around through undersink bends. It is a further object to provide a drain opener which has a pair of rollers positioned and shaped to guide the head of the drain opener around the bend normally found in undersink plumbing structures so that the drain opener can pass around the bends without the hanging up of the drain opener. It is a further object to provide a drain opener having a head thereon which has a pair of substantially frusto-conical rollers on a common axis shaped and dimensioned so that the head can pass around the required curves.

Other objects and advantages of this invention will become apparent from a study of the following portion of the specification, the claims, and the attached drawings.

DESCRIPTION OF THE PREFERRED EMBODIMENT

Figure 1:
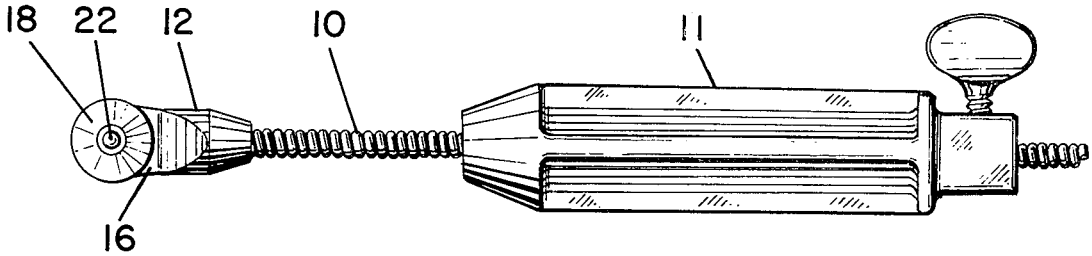
FIG. 1 is a side-elevational view of a drain opener, with parts broken away, having the head of this invention.
Figure 2:
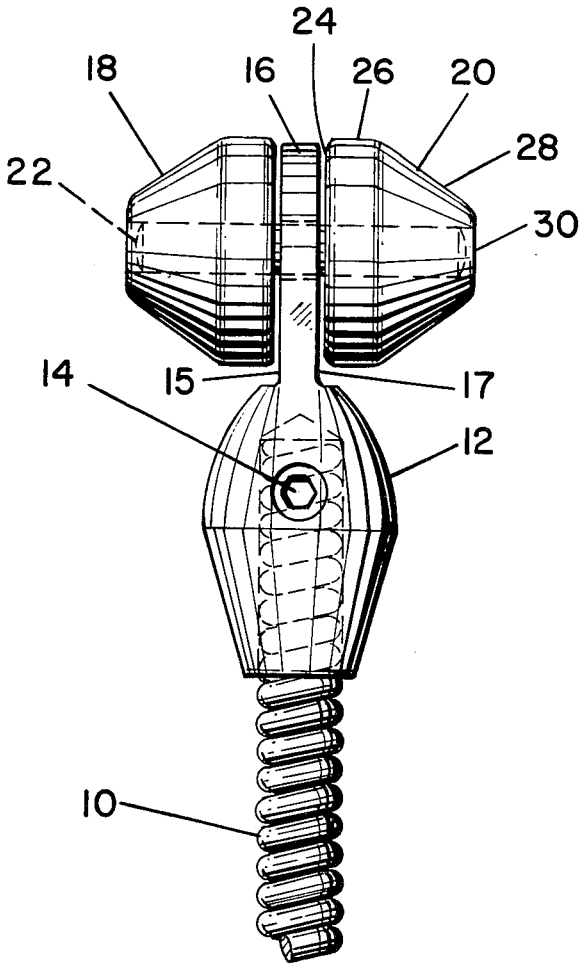
FIG. 2 is an enlarged top-plan view thereof.
Figure 3:
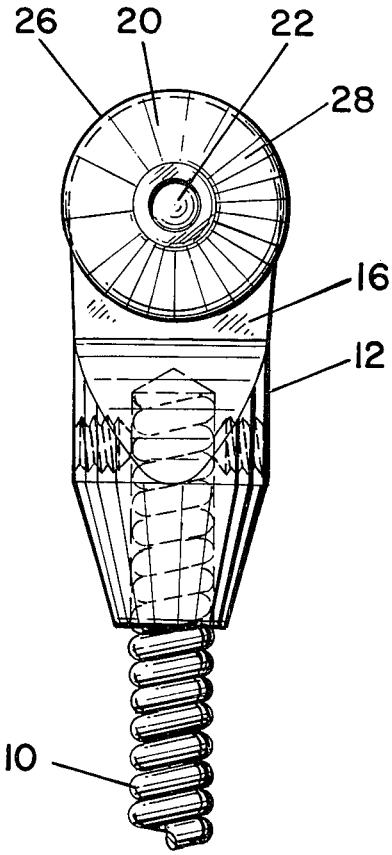
FIG. 3 is an enlarged side-elevational view of the head of FIG. 1.

The drain opener of this invention is seen in FIG. 1 with its flexible but stiff wire line snake member 10 carrying the head toward the left end and having its right end broken away so that it can be conveniently shown in the drawing. Snake member 10 can be of any convenient length and is preferably a wound-wire line configured as a spring, as shown in FIGS. 1, 2 and 3. The drain opener of this invention is particularly organized for the opening of small, undersink drains and for this purpose, the wound-wire snake member 10 is particularly small in diameter, such as 3/16 of an inch. The particular utility of this drain opener is that it operates around small bends, but the head is critically configured so that, when scaled up, it is also useful in going around the bends in larger diameter tubes and pipes. Handle 11 is positioned on snake member 10 and is clampable thereto by means of the thumbscrew toward its right end. Any handle configuration which can be unclamped, moved along the snake member to the desired location, and then clamped again is satisfactory. In fact, no handle is necessary, but a handle permits the more convenient application of force to the snake member and thereby to its head.

The drain opener head of this invention has a nose 12 which has a recess therein which the forward end of flexible wire line snake member 10 is positioned. Set screw 14 secures the nose in place on the forward end of snake member 10. Nose 12 is bullet-shaped with the tapered surface extending back toward the recess for the snake member and has a forward web end 16 defined by a pair of flat surfaces 15 and 17 which extend out past the bullet-shaped forward part of the nose 12. Web end 16 terminates at its forward end in a substantially half cylindrical surface. The axis of the forward surface is on the axis of pivot pin 22 which passes through and is rotatable in a hole in web end 16.

Rollers 18 and 20 are mounted on opposite sides of web end 16 and are fixed onto the pin 22. Rollers 18 and 20 each have an inner end 24, cylindrical outer diameter 26, a frusto-conical surface 28, and an outer end 30. Inner end 24 and out end 30 are substantially planar and are perpendicular to the axis of pin 22 on which the two rollers are mounted. The cylindrical outer diameter 26 is slightly larger in diameter than the hemicylindrical end of web end 16. Outer diameter 26 must extend beyond web end 16 to prevent the web end 16 from catching on projections inside the tube or pipe. Thus, the diameter of the hemicylindrical end of web 16 is in the order of 0.010 to 0.030 inch less than the diameter of cylindrical outer surface 26, with a preferred range of 0.010 to 0.015 inch. On the other hand, web end 16 must substantially fill the space between the inner end 24 of the two rollers to prevent the inner edges of the juncture between surfaces 24 and end 26 from being able to catch on projections. The space between the inner end surfaces and the flats on the sides of web 16 is adequate for rotation of the rollers. Clearance of 0.010 to 0.015 on each side is appropriate.

Frusto-conical surface 28 is formed of a cone having a total included angle in the range from 45 degrees to 90 degrees with the preferred angle of about 70 degrees. Outer end 30 is truncated so that there is material around the hole for pivot pin 22 so that the outer surface does not join the pivot pin hole with a sharp edge. Instead, the juncture between each of the surfaces is slightly rounded to take off the sharp edge, as illustrated in FIG. 2. Each of the edges is rounded so that there are no sharp edges to catch on projections in the pipe or in junctions between the various tube fittings. In this way, each of the surfaces is shaped to guide the head of the drain opener through the drain and to prevent it from hooking on projections.

In operation, handle 11 is positioned on snake member 10 an appropriate distance back from the head or nose 12 of the drain opener. For small sink drains, such as kitchen and bathroom lavatory drains, only about 12 to 18 inches of the snake member 10 need be exposed and, at this length, handle 10 is in a position to properly control the head 12. With this arrangement, the head 12 is inserted into the top of the drain and is thrust downward into the drain. The drain opener is worked back and forth with reciprocating motion along the length of the drain opener. As it meets an obstruction, repetitive efforts are used to thrust the drain opener past the obstruction. Since the rollers are shaped to go around the projections and bends inside the drain tube or pipe, the obstruction which is usually encountered is a foreign object in the drain, and it is this foreign object which must be dislodged to permit proper drain operation. The rollers aid in going around bends and past obstructions, and the feature that web end 16 fills the space between the rollers permits the drain opener to move ahead with least chance of hangup in the drain. When the obstruction is punctured, a flow of water washes out the loose material, and the reciprocation of the drain opener further clears that part of the drain.

The above is a description of the preferred embodiment which comprises a pair of rollers having convex guide surfaces. However, more broadly, the invention is directed to a guide wheel or wheels on the front end of a wire line which is flexible in all directions, with the wheel or wheels being shaped to guide the flexible wire line. In the case of a single wheel, the nose is bifurcated with the wheel between the forks. The forks are then convex on the outer surfaces, and the wheel is almost cylindrical so that an overall form of a center cylinder and a convex structure on each end is presented. Similarly, a three-wheel structure can be formed with a bifurcated nose with a cylindrical roller between the webs of the fork and convex or truncated conical rollers such as shown in the present FIG. 2 on the outside of the two web fingers of the bifurcated structure. In the case of a four-wheel structure, two axles are used with one in front of the other so that the front end looks like FIGS. 2 and 3, but there is a cross axle behind the front axle carrying an additional two rollers of the same general structure but in a different plane. In each case, convex guide rollers provide structures which guide the front end of the flexible wire line to prevent any portion thereof from hanging up on bends or shoulders on the interior of the pipe or tubing so that the drain opener can readily pass through an undersink drain with bending in any place as necessary to go through the multiple bends and with twisting of the line on its axis to aid in forcing its passage through the drain.

This invention having been described in its preferred embodiment, it is clear that it is susceptible to numerous modifications and embodiments within the ability of those skilled in the art and without the exercise of the inventive faculty. Accordingly, the scope of this invention is defined by the scope of the following claims.

What is claimed is:

1. A drain opener comprising:

a head for a flexible snake member, said head comprising a nose for attachment onto the flexible snake member, said nose having a forwardly projecting web end having opposed substantially flat surfaces, said web end having a substantially hemicylindrical forward surface, and an opening through said web end substantially normal to said flat surfaces;

a pivot pin extending through said opening;

first and second rollers mounted on said pivot pin respectively adjacent said first and second flat surfaces of said web end so they rotate with respect to said web, said first and second rollers each having a substantially cylindrical outer diameter, each of said rollers having a frusto-conical surface away from said web end, the total included angle of said frusto-conical surface being more than 45° and less than 90 degrees, the total length of said first and second rollers in the direction of said pivot pin when said rollers are located adjacent said web being greater than said cylindrical outer diameter of said rollers, the width of said web and said radius of said forward end of said web being substantially equal to and no larger than said cylindrical outer diameter of said rollers and said rollers lying substantially against said web end so that said web end substantially fills the space between said rollers.

2. The drain opener of claim 1 wherein said rollers are fixed to said pivot pin and said pivot pin is rotatably mounted in said opening through said web end.

3. The drain opener of claim 1 wherein said hemicylindrical surface is between 0.010 and 0.030 inch in diameter less than said cylindrical outer diameter of said rollers.

* * * * *